US006880541B2

(12) United States Patent
Hanazaki et al.

(10) Patent No.: US 6,880,541 B2
(45) Date of Patent: Apr. 19, 2005

(54) AIR-FUEL RATIO CONTROL APPARATUS FOR INTERNAL COMBUSTION ENGINE

(75) Inventors: Ryoichi Hanazaki, Tokyo (JP); Mitsuyasu Kunihiro, Tokyo (JP)

(73) Assignee: Mitsubishi Denki Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/785,076

(22) Filed: Feb. 25, 2004

(65) Prior Publication Data

US 2005/0065708 A1 Mar. 24, 2005

(30) Foreign Application Priority Data

Sep. 22, 2003 (JP) ..... 2003-329937

(51) Int. Cl.[7] ..... F02D 41/10

(52) U.S. Cl. ..... 123/698; 123/520; 123/682; 123/675

(58) Field of Search ..... 123/520, 698, 123/672, 674, 675, 682, 681; 701/101, 102, 103, 104

(56) References Cited

U.S. PATENT DOCUMENTS 4,986,070 A * 1/1991 Abe ..... 123/520
5,048,493 A * 9/1991 Orzel et al. ..... 123/520
5,626,122 A 5/1997 Azuma
6,227,177 B1 * 5/2001 Yamafuji et al. ..... 123/520
6,666,200 B1 * 12/2003 Davis et al. ..... 123/520

FOREIGN PATENT DOCUMENTS

JP 08-261038 A 10/1996

* cited by examiner

*Primary Examiner*—Tony M. Argenbright
*Assistant Examiner*—Arnold Castro
(74) *Attorney, Agent, or Firm*—Sughrue Mion, PLLC

(57) ABSTRACT

Air-fuel ratio control apparatus for an engine of automobile for controlling an air-fuel ratio to a desired value includes module (33) for computing a purge ratio (Pr) from a purge quantity (QPRG) and an engine operation state, module (35) for computing a purge air concentration (Pn) from the purge ratio (Pr) and an air-fuel ratio feedback correcting coefficient (CFB), module (36) for computing a purge air concentration correcting coefficient (CPRG) from the purge ratio and the purge air concentration, module (39) for computing a fuel injection quantity (Qf) supplied to the engine (6) from the purge air concentration correcting coefficient, and module (37) for detecting an accelerating state of the automobile. The purge air concentration correcting coefficient is reset to an initial value when the purge air concentration correcting coefficient is not greater than a predetermined value (indicating leanness) and when the acceleration is detected.

4 Claims, 9 Drawing Sheets

FIG. 6

BASIC ON-TIME PRGBSE (Ne, Ec) UNIT: [ms]

| CHARGING EFFICIENCY Ec [%] | ENGINE ROTATION NUMBER No [rpm] | | | | | | | |
|---|---|---|---|---|---|---|---|---|
| | 1000 | 1250 | 1500 | 2000 | 2500 | 3000 | 3500 | 4000 |
| 6.25 | 0 | 0 | 0 | 0 | 13 | 15 | 20 | 20 |
| 12.50 | 0 | 0 | 0 | 0 | 23 | 26 | 30 | 37 |
| 18.75 | 15 | 18 | 21 | 27 | 34 | 39 | 46 | 54 |
| 25.00 | 19 | 23 | 27 | 36 | 43 | 50 | 60 | 70 |
| 37.50 | 29 | 36 | 42 | 56 | 68 | 80 | 93 | 107 |
| 50.00 | 46 | 57 | 68 | 90 | 103 | 120 | 143 | 167 |
| 62.50 | 80 | 100 | 120 | 158 | 200 | 214 | 255 | 255 |
| 75.00 | 255 | 255 | 255 | 255 | 255 | 255 | 255 | 255 |

FIG. 7

BASIC ON-TIME QPRGBSE (Ne, Ec) UNIT: [g/sec]

| CHARGING EFFICIENCY Ec [%] | ENGINE ROTATION NUMBER No [rpm] | | | | | | | |
|---|---|---|---|---|---|---|---|---|
| | 1000 | 1250 | 1500 | 2000 | 2500 | 3000 | 3500 | 4000 |
| 6.25 | 0.000 | 0.000 | 0.000 | 0.000 | 0.075 | 0.087 | 0.102 | 0.120 |
| 12.50 | 0.000 | 0.000 | 0.000 | 0.000 | 0.146 | 0.178 | 0.204 | 0.234 |
| 18.75 | 0.089 | 0.111 | 0.133 | 0.176 | 0.224 | 0.269 | 0.311 | 0.359 |
| 25.00 | 0.121 | 0.148 | 0.178 | 0.238 | 0.293 | 0.350 | 0.414 | 0.477 |
| 37.50 | 0.179 | 0.226 | 0.265 | 0.356 | 0.445 | 0.535 | 0.623 | 0.720 |
| 50.00 | 0.240 | 0.300 | 0.358 | 0.481 | 0.582 | 0.701 | 0.831 | 0.975 |
| 62.50 | 0.294 | 0.368 | 0.442 | 0.581 | 0.736 | 0.856 | 1.000 | 1.066 |
| 75.00 | 0.260 | 0.153 | 0.166 | 0.179 | 0.268 | 0.260 | 0.191 | 0.278 |

AIR-FUEL RATIO CONTROL APPARATUS FOR INTERNAL COMBUSTION ENGINE

BACKGROUND OF THE INVENTION

1. Field of the Invention

The present invention generally relates to an air-fuel ratio control apparatus for an internal combustion engine installed on an automobile or a motor vehicle. More particularly, the present invention is concerned with a technique for improving or enhancing an acceleration performance of the internal combustion engine equipped with the air-fuel ratio control apparatus which incorporates therein an air-fuel ratio feedback control function and a purge control function.

2. Description of Related Art

In general, the air-fuel ratio control apparatus for the internal combustion engine ordinarily incorporates the purge control function for causing a fuel vapor (i.e., vaporized fuel) originating in a fuel tank or the like to be adsorbed by activated carbon and purged to be introduced into an intake system of the engine as occasion arises. Further, the fuel injection apparatus of the internal combustion engine is equipped with an air-fuel ratio feedback control function for making the air-fuel ratio of the air-fuel mixture coincide with the theoretical air-fuel ratio.

In the air-fuel ratio control apparatus for the internal combustion engine equipped with the air-fuel ratio feedback control function and the purge control function as described above, the air-fuel ratio feedback correcting coefficient (multiplication coefficient) changes around a reference value (e.g. 1.0) when the adsorbed fuel vapor is not undergoing the purge process.

On the other hand, when the purge process is started, the fuel injection quantity has to be decreased by an amount or quantity corresponding to that of the purged fuel vapor introduced into the intake system. Accordingly, the air-fuel ratio feedback correcting coefficient is set to a value smaller than 1.0.

In that case, deviation or difference between the air-fuel ratio feedback correcting coefficient (<1.0) and the reference value (=1.0) when the purge process is being effected and the reference value (=1.0) assumes a variable value in dependence on the operation state of the internal combustion engine, i.e., ratio between the purge quantity and the intake air quantity (hereinafter referred to as the purge ratio).

Further, the air-fuel ratio feedback correcting coefficient is so determined as to change relatively slowly in accordance with a predetermined integration constant with a view to evading a sudden change of the air-fuel ratio.

Consequently, when the purge ratio changes in the course of the purge process due to transient operation, relatively much time is taken for the purge ratio to settle at the value after the change from the preceding value. Consequently, it is impossible to maintain the air-fuel ratio at the theoretical air-fuel ratio (=14.7) during a time period taken for the purge ratio to become steady.

Under the circumstances, there has been proposed an air-fuel ratio control apparatus for the internal combustion engine which apparatus is designed to make the air-fuel ratio feedback correcting coefficient coincide with a desired value by correcting the fuel injection quantity in accordance with the purge air concentration correcting coefficient during the purge process. In this conjunction, reference may have to be made to, for example, Japanese Patent Application Laid-Open Publication No. 261038/1996 (JP-A-1996-261038).

In the air-fuel ratio control apparatus mentioned above, the purge ratio is arithmetically determined or computed on the basis of the engine operation state and the purge quantity, a purge air concentration is computed on the basis of the purge ratio and the air-fuel ratio feedback correcting coefficient, a purge air concentration correcting coefficient is computed on the basis of the purge ratio and the purge air concentration, and then the fuel injection quantity is corrected in conformance with the purge air concentration correcting coefficient to thereby effectuate the control for making the air-fuel ratio feedback correcting coefficient coincide with a target or desired value.

In this conjunction, it is noted that when the internal combustion engine is accelerated with the purge air being introduced to the engine, vacuum or negative pressure (absolute value) within the intake passage decreases while the intake quantity increases. Besides, the purge air concentration of the intake air decreases remarkably in accompanying the decrease of the adsorbed fuel. Accordingly, there arises the necessity of controlling the air-fuel ratio toward richness of the air-fuel mixture by increasing the fuel injection quantity.

However, in the case where the purge air concentration and the purge air concentration correcting coefficient are computed on the basis of the purge ratio as mentioned above, the purge air concentration correcting coefficient updated to a value smaller than 1.0 by learning the immediately preceding engine operation state will gradually increase (approach to 1.0) in response to lowering of the purge ratio when the engine is accelerated, as a result of which the air-fuel ratio changes toward richness of the air-fuel mixture.

The air-fuel ratio control apparatus for the internal combustion engine known heretofore suffers a problem that even when the fuel injection quantity is corrected with the purge air concentration arithmetically determined from the purge ratio and the air-fuel ratio feedback correcting coefficient so that the air-fuel ratio feedback correcting coefficient becomes constant, the purge air of high purge ratio (i.e., remarkably rich purge air) will unwantedly be introduced in the intake system of the engine because it takes a lot of time for the purge air concentration correcting coefficient to be updated to a value for enriching the air-fuel mixture in response to lowering of the purge ratio for the enriching demand upon acceleration of the engine.

In particular, in the case where the engine operation is suddenly accelerated in the state where the purge air concentration correcting coefficient has been updated to a value for remarkably leaning the air-fuel mixture (i.e., value sufficiently smaller than 1.0 and closer to zero) due to the rich purge air in the initial phase, the air-fuel ratio remains on the lean side over a long time period taken for the purge air concentration correcting coefficient to assume the enriching value (i.e., to resume the value of 1.0), as a result of which degradation of the acceleration performance such as hesitation will unwantedly be incurred.

SUMMARY OF THE INVENTION

In the light of the state of the art described above, it is an object of the present invention to solve the problem mentioned above by providing an improved air-fuel ratio control apparatus for an internal combustion engine which apparatus is capable of controlling the air-fuel ratio of a gas mixture introduced into the internal combustion engine to a desired value constantly or steadily with high accuracy.

In view of the above and other objects which will become apparent as the description proceeds, there is provided according to a general aspect of the present invention an air-fuel ratio control apparatus for an internal combustion engine, which apparatus includes a sensor means of various types for detecting operation states of the internal combustion engine installed on a motor vehicle, an air-fuel ratio sensor for detecting an air-fuel ratio of an air-fuel mixture gas supplied to the internal combustion engine, a fuel injector for injecting a fuel contained in a fuel tank into an intake system of the internal combustion engine, a canister for adsorbing a fuel vapor from the fuel tank, a purge control valve for introducing the adsorbed fuel of the canister into the intake system of the internal combustion engine, and an engine control unit for activating the canister and driving the purge control valve on the basis of detection signals of the various sensor means and the air-fuel ratio sensor.

In the air-fuel ratio control apparatus described above, the engine control unit is comprised of an acceleration decision means for making decision as to accelerating state of the motor vehicle on the basis of the engine operation state, an air-fuel ratio control means for arithmetically determining a fuel injection quantity on the basis of the engine operation state to thereby drive the fuel injector while controlling the air-fuel ratio to a desired value thereof through a feedback control on the basis of the detection signal of the air-fuel ratio sensor, a purge control means for driving the purge control valve on the basis of the engine operation state, and a fuel correction arithmetic means for arithmetically determining a purge air concentration correcting coefficient for correcting the fuel injection quantity on the basis of the control quantity for the purge control valve validated by the purge control means and the engine operation state, wherein the fuel correction arithmetic means is so designed as to reset the purge air concentration correcting coefficient to an initial value when the purge air concentration correcting coefficient becomes smaller than a predetermined value inclusive thereof, indicating leanness of the air-fuel mixture and when it is determined that the motor vehicle is in the accelerating state.

With the arrangement of the air-fuel ratio control apparatus for the internal combustion engine described above, the air-fuel ratio can be controlled with high accuracy without degrading the acceleration performance even in the case where the engine operation is accelerated from the operation state where the rich purge air of a high purge ratio is being introduced by virtue of such arrangement that the purge air concentration correcting coefficient is reset to the initial value when the purge air concentration correcting coefficient becomes smaller than the predetermined value inclusive (indicating leanness of the air-fuel mixture) and when acceleration of the motor vehicle is detected.

The above and other objects, features and attendant advantages of the present invention will more easily be understood by reading the following description of the preferred embodiments thereof taken, only by way of example, in conjunction with the accompanying drawings.

BRIEF DESCRIPTION OF THE DRAWINGS

In the course of the description which follows, reference is made to the drawings, in which:

FIG. 6 is a view for illustrating exemplary map data of basic on-time (PRGBSE) of a purge control valve (10) according to the first embodiment of the invention;

FIG. 7 is a view for illustrating exemplary map data of purge flow rate reference values (QPRGBSE) according to the first embodiment of the invention;

DESCRIPTION OF THE PREFERRED EMBODIMENTS

Figure 1:
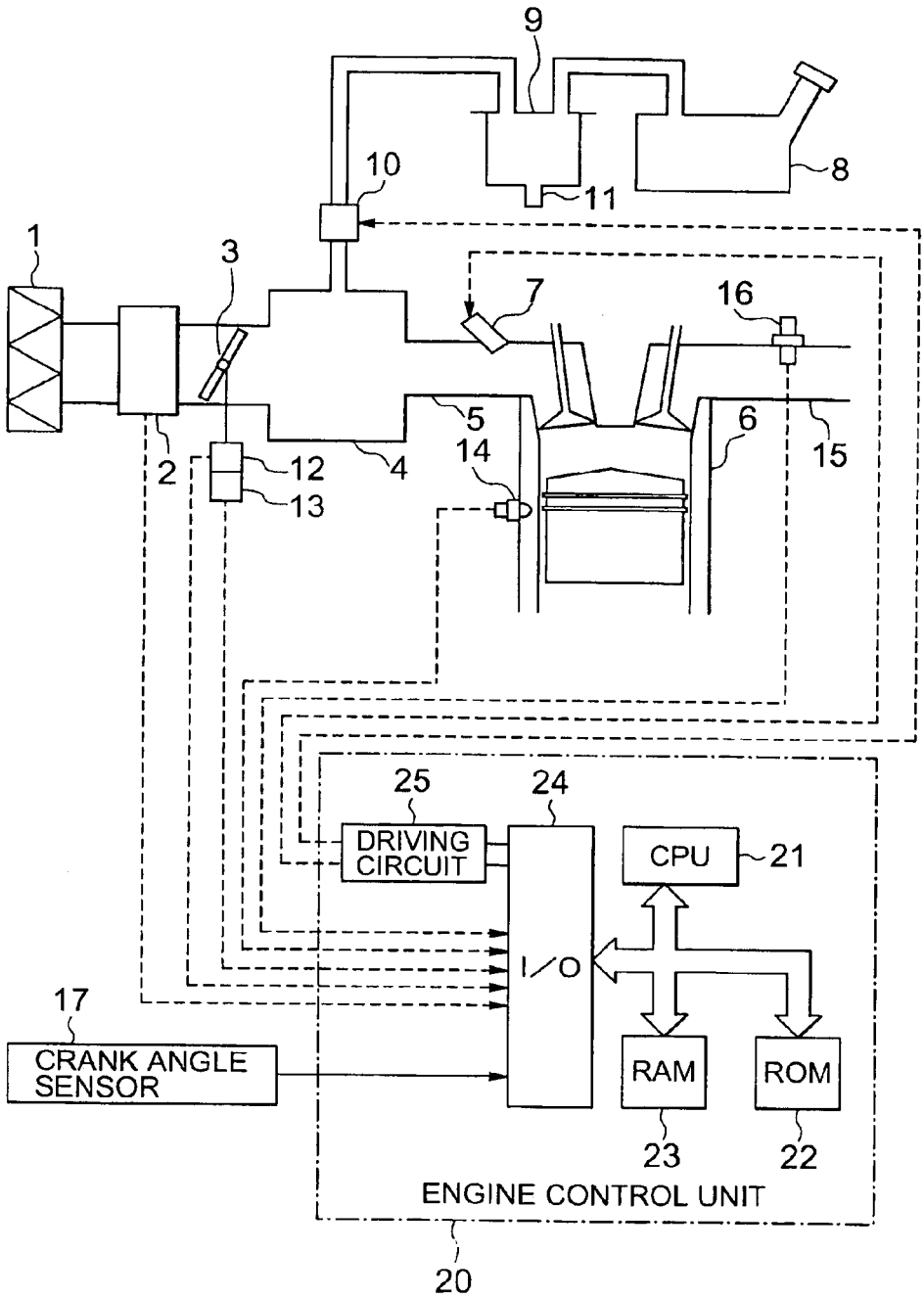
FIG. 1 is a functional block diagram showing generally and schematically a configuration of an air-fuel ratio control apparatus for an internal combustion engine according to a first embodiment of the present invention.

The present invention will be described in detail in conjunction with what is presently considered as preferred or typical embodiments thereof by reference to the drawings. In the following description, like reference characters designate like or corresponding parts or items throughout the several views.

Embodiment 1

FIG. 1 is a functional block diagram showing generally and schematically a configuration of the air-fuel ratio control apparatus for an internal combustion engine according to a first embodiment of the present invention.

Referring to FIG. 1, intake air cleaned through an air cleaner 1 is fed to individual cylinders of the internal combustion engine 6 by way of an air flow sensor 2, a throttle valve 3, a surge tank 4 and an intake manifold or pipe 5. In that case, the flow rate or quantity Qa of the intake air is measured by the air flow sensor 2 while it is controlled by the throttle valve 3 in dependence on a load applied onto the engine 6.

On the other hand, fuel is injected into the intake pipe 5 through a fuel injector 7. Further, vaporized fuel (hereinafter also referred to as the fuel vapor) generated internally of a fuel tank 8 is adsorbed by a canister 9 containing activated carbon (or activated charcoal) therein. The fuel vapor adsorbed by the canister 9 is purged therefrom to be introduced into the surge tank 4 as the so-called purge air in dependence on the operation state of the engine 6.

More specifically, when a purge control valve 10 is opened in dependence on a purge valve control quantity which is determined on the basis of the operation state of the engine 6, the ambient air is introduced into the canister 9 through an inlet port 11 thereof opened to the atmosphere under a negative pressure or vacuum prevailing within the surge tank 4 to be caused to flow through a mass of activated carbon accommodated within the canister 9. As a result of this, the fuel vapor is purged off from the activated carbon to be introduced into the surge tank 4 as the purge air (i.e., the air carrying the fuel vapor purged off from the activated carbon).

The throttle valve 3 is provided with a throttle sensor 12 for detecting a throttle opening degree 8 and an idle switch 13 which is closed or turned on when the throttle valve 3 is set to the opening degree for the idling operation.

Further, the internal combustion engine 6 is provided with a water temperature sensor 14 for detecting the temperature WT of engine cooling water. Additionally, an exhaust pipe 15 of the engine 6 is equipped with an air-fuel ratio sensor 16. Moreover, a crank angle sensor 17 is provided in association with a crank shaft (not shown) of the engine 6.

An engine control unit 20 is constituted by a microcomputer which is comprised of a CPU (Central Processing Unit) 21, a ROM (Read-Only Memory) 22, a RAM (Random Access Memory) 23 and others for carrying out a variety of controls such as an air-fuel ratio control, an ignition timing control, etc. Output signals of various sensors indicating the operation states of the engine 6 are inputted to the engine control unit 20 through the medium of an input/output interface 24.

As the various sensor output signals, there may be mentioned those indicating the intake air quantity (hereinafter also referred to as the intake quantity) Qa measured by the air flow sensor 2, the throttle opening degree θ detected by the throttle sensor 12, the on-signal of the idle switch 13 indicating the throttle opening degree in the idling operation, the engine cooling water temperature WT detected by the water temperature sensor 14, an air-fuel ratio feedback signal (output voltage VO2) from the air-fuel ratio sensor 16 and an engine seed or engine rotation number Ne [rpm] detected by the crank angle sensor 17.

By the way, the air flow sensor 2, the throttle sensor 12, the idle switch 13, the water temperature sensor 14, the air-fuel ratio sensor 16 and the crank angle sensor 17 cooperate to constitute an engine operation state detecting means (i.e., the various sensors).

The CPU 21 constituting a major part of the engine control unit 20 performs arithmetic operations for the feedback control of the air-fuel ratio (also referred to as the air-fuel ratio feedback control) in accordance with a control program or programs on the basis of various data maps stored in the ROM 22, to thereby drive the fuel injector 7 through the medium of a driving circuit 25.

Further, the engine control unit 20 is designed to execute a purge processing in dependence on the operation states of the internal combustion engine in addition to other various controls such as an ignition timing control, an EGR (Exhaust Gas Recirculation) control, an idling rotation speed control, etc.

By way of example, when the engine cooling water temperature WT attains or exceeds a predetermined temperature after the engine has been warmed up and when the engine rotation number Ne [rpm] is higher than a predetermined rotation number [rpm] inclusive, the engine control unit 20 outputs a canister purge signal for driving the purge control valve 10 to thereby carry out the purge processing of the canister 9 described previously. Subsequently, when the idle operation of the engine is validated, the idle operation state is detected in response to the on-signal of the idle switch 13 (i.e., the signal indicating that the idle switch 13 is closed) to thereby interrupt the purge processing of the canister 9 by opening or turning off the purge control valve 10.

Figure 2:
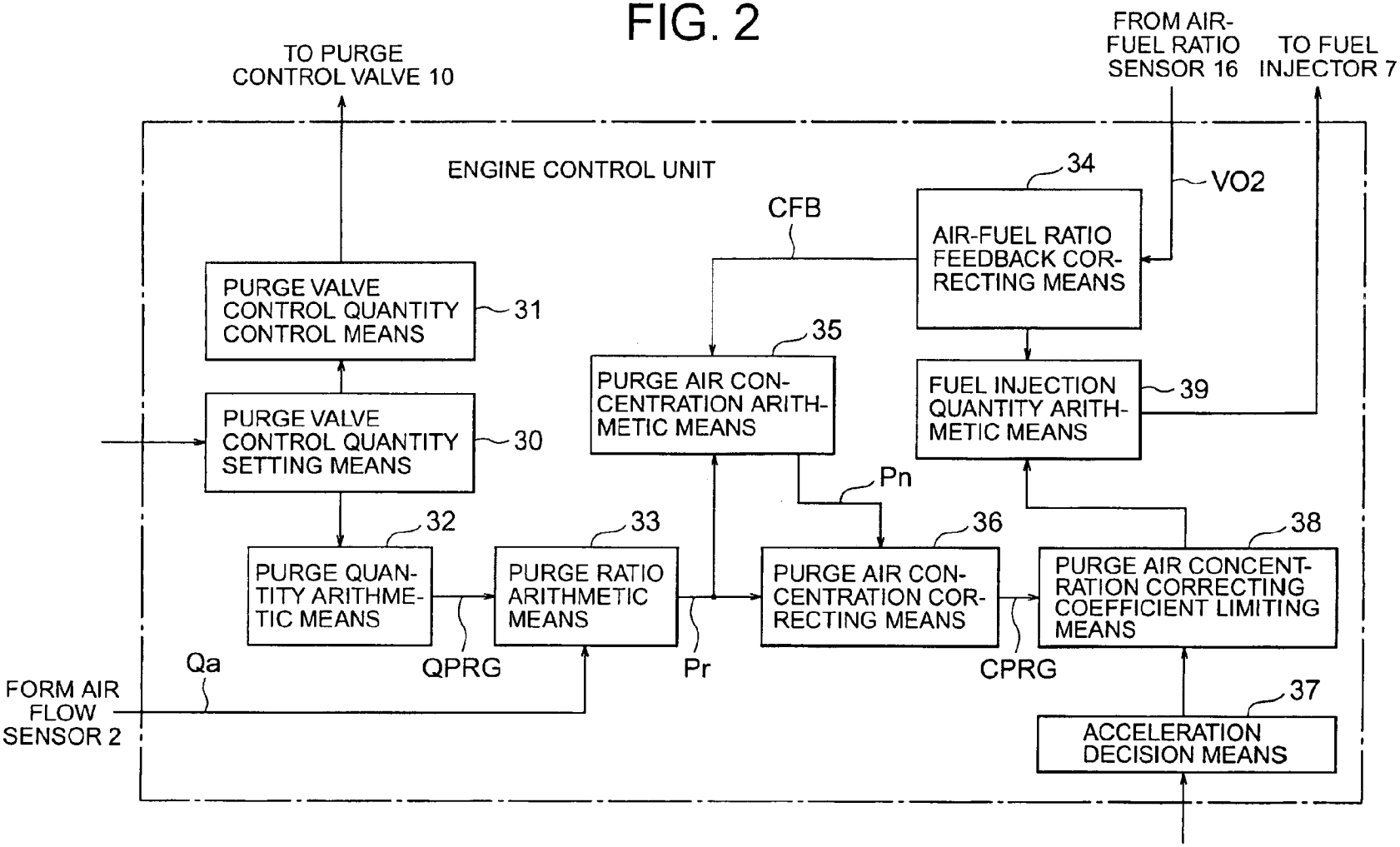
FIG. 2 is a functional block diagram showing an arrangement of a control unit incorporated in the air-fuel ratio control apparatus for the internal combustion engine according to the first embodiment of the invention.

FIG. 2 is a functional block diagram for illustrating control functions of the engine control unit 20 incorporated in the air-fuel ratio control apparatus for the internal combustion engine according to the first embodiment of the invention.

In FIG. 2, peripheral structural arrangement of the engine 6 as well as the various sensors are omitted from illustration.

As can be seen in FIG. 2, the engine control unit 20 is comprised of a purge valve control quantity setting means 30, a purge valve control quantity control means 31, a purge quantity arithmetic means 32, a purge ratio arithmetic means 33, an air-fuel ratio feedback correcting means 34, a purge air concentration arithmetic means 35, a purge air concentration correcting means 36, an acceleration decision means 37, a purge air concentration correcting coefficient limiting means 38 and a fuel injection quantity arithmetic means 39.

The purge valve control quantity setting means 30 and the purge valve control quantity control means 31 cooperate to constitute a purge quantity control means.

The purge valve control quantity setting means 30 is so programmed or designed as to detect the operation state of the engine 6 on the basis of the various sensor information for setting a purge valve control quantity which is determined in dependence on the engine operation state. On the other hand, the purge valve control quantity control means 31 is designed to control the opening ratio of the purge control valve 10 in conformance with the purge valve control quantity set by the purge valve control quantity setting means 30.

The purge quantity arithmetic means 32 is designed to arithmetically determine a purge quantity (i.e., quantity of the purge air) QPRG to be fed or introduced into the intake pipe 5 on the basis of the purge valve control quantity set by the purge valve control quantity setting means 30.

The purge ratio arithmetic means 33 is designed to arithmetically determine the purge ratio Pr on the basis of the intake quantity Qa detected by the air flow sensor 2 and the purge quantity QPRG arithmetically determined by the purge quantity arithmetic means 32.

The air-fuel ratio feedback correcting means 34 is designed to serve as the air-fuel ratio control means for arithmetically determining or computing the air-fuel ratio feedback correcting coefficient CFB to correct the fuel injection quantity Qf on the basis of the detection signal derived from the output of the air-fuel ratio sensor 16 so that the air-fuel ratio coincides with a target or desired air-fuel ratio.

The purge air concentration arithmetic means 35 is designed to compute a purge air concentration Pn on the basis of deviation of the air-fuel ratio feedback correcting coefficient CFB which may make appearance in the course of execution of the purge processing and the purge ratio Pr.

The purge air concentration correcting means 36 is designed to compute a purge air concentration correcting coefficient CPRG for correcting the fuel injection quantity Qf on the basis of the purge air concentration Pn and the purge ratio Pr in the course of execution of the purge processing.

The acceleration decision means 37 is designed to detect the accelerating state of the motor vehicle on the basis of the various sensor information.

The purge air concentration correcting coefficient limiting means 38 is so designed as to set the purge air concentration correcting coefficient CPRG to an initial value (0.1.0) or alternatively limit the purge air concentration correcting coefficient CPRG to a value reflecting a predetermined value (e.g. an intermediate value between the predetermined value and 1.0) immediately when the purge air concentration correcting coefficient CPRG becomes equal to or smaller than the above-mentioned predetermined value (on the order of 0.6) indicating leanness of the air-fuel mixture and when the accelerating state of the motor vehicle is determined on the basis of the result of the decision made by the acceleration decision means 37 and the purge air concentration correcting coefficient CPRG computed by the purge air concentration correcting means 36.

The fuel injection quantity arithmetic means 39 is designed to arithmetically determine or compute the fuel injection quantity Qf on the basis of the air-fuel ratio feedback correcting coefficient CFB and the purge air concentration correcting coefficient CPRG.

Next, description will be made of basic operations carried out by the air-flow ratio control apparatus according to the first embodiment of the invention shown in FIGS. 1 and 2.

In the internal combustion engine 6 shown in FIG. 1, the fuel injection quantity Qf is basically computed in accordance with the undermentioned expression (1):

$$Qf=\{(Qa/Ne)/AFo\}\times CFB\times CPRG\times K+\alpha \quad (1)$$

where Qa represents the intake quantity,

Ne represents the engine rotation number [rpm],

AFo represents the desired air-fuel ratio,

CFB represents the air-fuel ratio feedback correcting coefficient,

CPRG represents the purge air concentration correcting coefficient,

K represents a first correcting coefficient, and $\alpha$ represents a second correcting coefficient.

The first correcting coefficient K mentioned above is a value which contributes to the multiplication (e.g. warm-up correcting coefficient) and assumes 1.0 (i.e., K=1.0) unless the correction is required.

On the other hand, the second correcting coefficient a is a value contributing to the addition (e.g. increment for acceleration increment), wherein $\alpha$=0 unless the correction is necessary.

The purge air concentration correcting coefficient CPRG is employed for correcting the fuel injection quantity Qf on the basis of the purge air concentration Pn and the purge ratio Pr when the purge is carried out. So long as the purge is not effected, the purge air concentration correcting coefficient CPRG assumes 1.0 (i.e., CPRG=1.0).

The air-fuel ratio feedback correcting coefficient CFB is employed for controlling the air-fuel ratio so long as to make it coincide with the desired or target air-fuel ratio Afo on the basis of the output voltage VO2 of the air-fuel ratio sensor 16.

Incidentally, the desired air-fuel ratio Afo may be set to an arbitrary or given value. However, for the convenience of description it is assumed that the desired air-fuel ratio Afo is set at the stoichiometric or theoretical air-fuel ratio (=14.7).

In this case, in the purge control, the air-fuel ratio is so controlled as to conform with the desired air-fuel ratio Afo by updating the purge air concentration correcting coefficient CPRG. In that case, the air-fuel ratio feedback correcting coefficient CFB which takes a time for updating is maintained at a predetermined value. Thus, there is no necessity of updating the air-fuel ratio feedback correcting coefficient CFB which takes a time for updating. Consequently, the air-fuel ratio can speedily be so controlled as to coincide with the desired air-fuel ratio Afo.

The air-fuel ratio sensor 16 (also called the $O_2$-sensor in general) is designed to generate the output voltage VO2 on the order of 0.9 [V] (volt) when the air-fuel ratio indicates richness of the air-fuel mixture while generating the output voltage VO2 on the order of 0.1 [V] in the case where the air-fuel ratio indicates leanness of the air-fuel mixture.

Next, referring to the flow chart shown in FIG. 3, description will be made of a processing procedure or routine for controlling the air-fuel ratio feedback correcting coefficient CFB by the air-flow ratio control apparatus according to the first embodiment of the invention.

Figure 3:
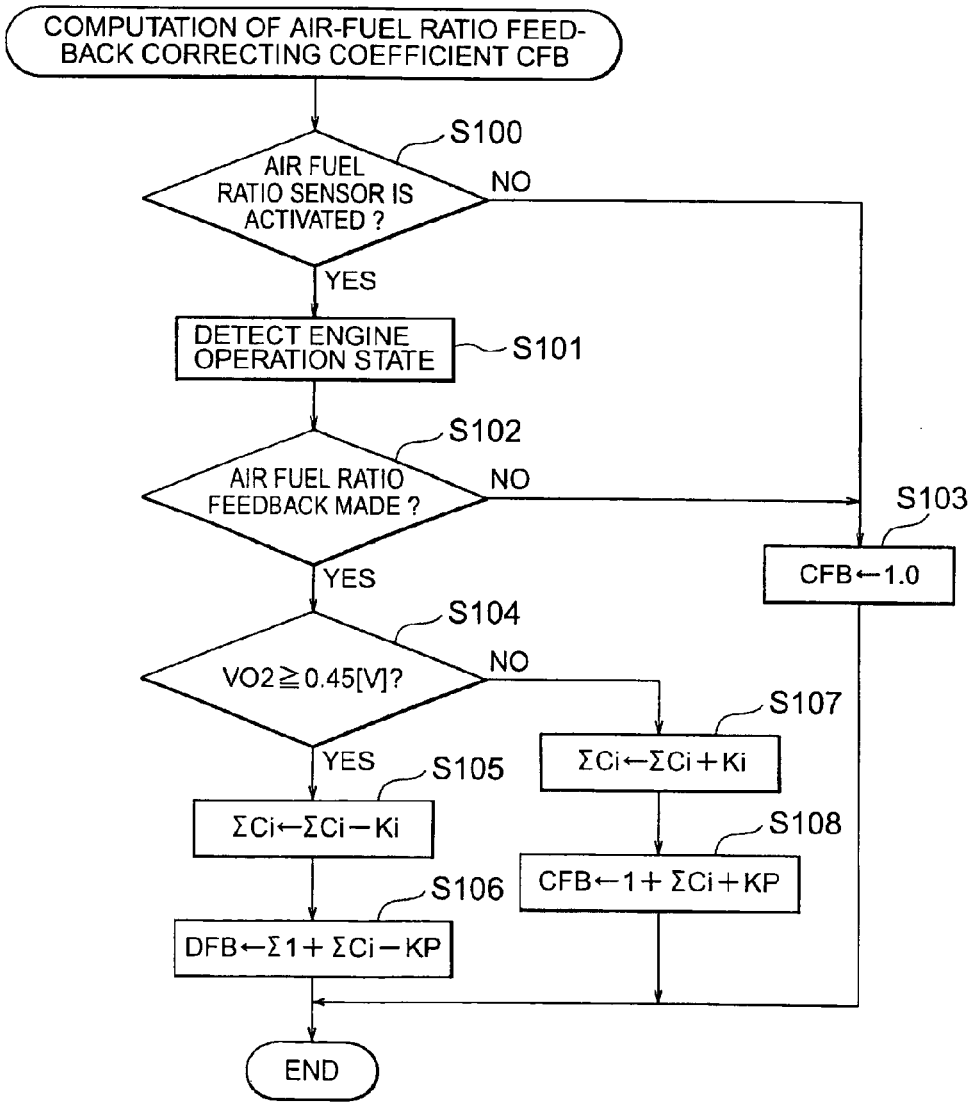
FIG. 3 is a flow chart for illustrating an arithmetic processing procedure for computing an air-fuel ratio feedback correcting coefficient (CFB) in the apparatus according to the first embodiment of the invention.

The processing procedure for controlling the air-fuel ratio feedback correcting coefficient CFB illustrated in FIG. 3 is executed by the air-fuel ratio feedback correcting means 34 incorporated in the engine control unit 20 on the basis of the output voltage VO2 of the air-fuel ratio sensor 16.

FIG. 3 illustrates a routine for arithmetically determining or computing the air-fuel ratio feedback correcting coefficient CFB which is generally known.

Referring to FIG. 3, decision is firstly made as to whether or not the air-fuel ratio sensor 16 is activated in a step S100. When it is determined that the air-fuel ratio sensor 16 is activated (i.e., when the decision step S100 results in affirmation "YES"), the signals derived from the outputs of the crank angle sensor 17, the air flow sensor 2, the throttle sensor 12, the water temperature sensor 14 etc. are fetched to detect the operation state of the engine in a step S101.

In succession, it is decided whether or not the fuel injection control mode is the air-fuel ratio feedback mode on the basis of the detected operation state of the engine in a step S102.

On the other hand, when it is determined in the step S100 that the air-fuel ratio sensor 16 is not activated yet (i.e., when the decision step S100 results in negation "NO"), the air-fuel ratio feedback correcting coefficient CFB is set to "1.0" in a step S103, whereupon the processing routine illustrated in FIG. 3 comes to an end (END).

Similarly, when it is determined in the step S102 that the fuel injection control mode is not the air-fuel ratio feedback control mode but the enrich mode, the fuel cut mode or other (i.e., when the step S102 results in negation "NO"), the air-fuel ratio feedback correcting coefficient CFB is set to "1.0" in the step S103, whereupon the routine illustrated in FIG. 3 comes to an end.

By contrast, when it is determined in the step S102 that the fuel injection control mode is the air-fuel ratio feedback control mode (i.e., when the decision step S102 results in "YES"), then decision is made in succession as to whether or not the exhaust gas at the current time point (hereinafter also referred to as the current exhaust gas) is rich by checking whether or not the output voltage VO2 of the air-fuel ratio sensor 16 is higher than 0.45 [V] inclusive in a step S104.

When the exhaust gas indicates richness of the gas mixture and when it is decided in the step S104 that the output voltage VO2 is higher than 0.45 [V] inclusive, (i.e., when the step S104 results in "YES"), a value resulting from the subtraction of a relatively small integration correcting gain Ki from the integrated feedback integration correcting coefficient value $\Sigma$ Ci is updated to a new integrated feedback integration correcting coefficient value $\Sigma$Ci in a step S105.

In succession, a relatively large proportional correcting value (skip value) KP is subtracted from a value resulting from the addition of the reference value (=1.0) of the air-fuel ratio feedback correcting coefficient CFB and the updated integrated feedback integration correcting coefficient value $\Sigma$ Ci, to thereby arithmetically determine the air-fuel ratio feedback correcting coefficient CFB in a step S106, whereupon the processing routine illustrated in FIG. 3 comes to an end.

On the other hand, when the exhaust gas is lean and when it is determined in the step S104 that the output voltage VO2 is lower than 0.45 [V] (i.e., when the decision step S104 results in "NO"), the value resulting from the addition of the integration correcting gain Ki to the integrated feedback integration correcting coefficient value ΣCi is set as the updated integrated feedback integration correcting coefficient value ΣCi in a step S107.

In succession, the proportional correcting value KP is added to the value resulting from the addition of the reference value (=1.0) of the air-fuel ratio feedback correcting coefficient CFB and the updated integrated feedback integration correcting coefficient value ΣCi, to thereby arithmetically determine the air-fuel ratio feedback correcting coefficient CFB in a step S108, whereupon the processing routine illustrated in FIG. 3 comes to an end.

Incidentally, the integrated feedback integration correcting coefficient value ΣCi changes in dependence on the state of the purge, as will be described in detail later on. Accordingly, the air-fuel ratio feedback correcting coefficient CFB is correctively modified in dependence on the state of the purge in the steps S105, S106; S107, S108 mentioned above.

As is apparent from the foregoing, when the oxygen concentration of the exhaust gas is rich as compared with the theoretical air-fuel ratio, the air-fuel ratio feedback correcting coefficient CFB is set to a small value (step S106), whereby the fuel injection quantity is decreased. By contrast, when the oxygen concentration of the exhaust gas indicates leanness when compared with the theoretical air-fuel ratio, the air-fuel ratio feedback correcting coefficient CFB is set to a large value (step S108), whereby the fuel injection quantity is increased.

In this manner, the air-fuel ratio is maintained at the value which constantly coincides with the theoretical air-fuel ratio through the feedback control of the air-fuel ratio. Incidentally, in the state in which the purge is not effectuated, the air-fuel ratio feedback correcting coefficient CFB varies substantially around the value of 1.0.

Now, description will be directed to the purge control performed by the air-flow ratio control apparatus according to the first embodiment of the invention.

Referring to FIG. 1, the purge control valve 10 is subjected to a duty control periodically at a driving interval of 100 [msec] by means of the engine control unit 20 through the medium of the driving circuit 25.

In this conjunction, the on-time TPRG of the purge control valve 10 (i.e., time for which the purge control valve 10 is driven) is arithmetically determined in accordance with the undermentioned expression (2):

$$TPRG=PRGBSE\times KPRG\times Kx \quad (2)$$

where PRGBSE represents a basic on-time of the purge control valve 10,

KPRG represents an initial decreasing coefficient of the purge air flow rate (hereinafter also referred to as the initial purge air flow rate decreasing coefficient), and Kx represents a correcting coefficient for the on-time TPRG (hereinafter also referred to as the on-time correcting coefficient).

The on-time correcting coefficient Kx represents collectively correction of the water temperature and correction of the intake air temperature and ordinary assumes a value of "1.0" after the warm-up of the engine 6.

The basic on-time PRGBSE of the purge control valve 10 can be determined by referencing a two-dimensional data map of the engine rotation number Ne [rpm] arithmetically determined on the basis of the pulse signal outputted from the crank angle sensor 17 and the charging efficiency Ec arithmetically determined on the basis of the engine rotation number Ne [rpm] and the intake air quantity Qa. In the two-dimensional data map mentioned above, the on-times or on-durations of the purge control valve 10 which can ensure the purge ratio Pr to be constant are listed.

The initial purge air flow rate decreasing coefficient KPRG is employed for correctively decreasing the purge air flow rate so that the purge of a large amount is not effected in the case where the fuel vapor adsorption state of the canister 9 is unknown, as is encountered after the start of the engine operation. The initial purge air flow rate decreasing coefficient KPRG can arithmetically be determined in accordance with the following expression (3):

$$KPRG=\min\{KKPRG\times\Sigma QPRG+KPGOFS,\ 1.0\} \quad (3)$$

where "min{ }" means that "KKPRG×ΣQPRG+KPGOFS" and "1.0" are compared with each other, whereby the smaller value is selected as the initial purge air flow rate decreasing coefficient KPRG. Further, in the expression (3), KKPRG represents an initial purge air flow rate decreasing coefficient gain, ΣQPRG represents an integrated value of the purge quantity QPRG after the start of the engine operation, and KPGOFS represents an offset of the initial purge air flow rate decreasing coefficient (hereinafter also referred to as the initial purge air flow rate decreasing coefficient).

The initial value of the integrated purge quantity value ΣQPRG after the start of engine operation is "0" (zero).

Since the integrated purge quantity value ΣQPRG is "0" immediately after the start of engine operation, the initial purge air flow rate decreasing coefficient offset KPGOFS is set as the initial value of the initial purge air flow rate decreasing coefficient KPRG after the start of engine operation.

The initial purge air flow rate decreasing coefficient gain KKPRG represents the incrementing ratio of the initial purge air flow rate decreasing coefficient KPRG.

Thus, the initial purge air flow rate decreasing coefficient KPRG is set to the initial value which is equal to the initial purge air flow rate decreasing coefficient offset KPGOFS immediately after the start of engine operation and is increased at the incrementing ratio of the initial purge air flow rate decreasing coefficient gain KKPRG as the purge proceeds. The initial purge air flow rate decreasing coefficient KPRG is limited by "1.0".

Owing to the action and effect of the initial purge air flow rate decreasing coefficient KPRG described above, the on-time TPRG of the purge control valve 10 assumes the value smaller than the basic on-time PRGBSE just after the start of engine operation, which value then increases gradually up to the basic on-time PRGBSE as the purge process proceeds.

Incidentally, the initial purge air flow rate decreasing coefficient gain KKPRG and the initial purge air flow rate decreasing coefficient offset KPGOFS are set through the processing in the steps S205, S206, S207, S208 and S209 described hereinafter by reference to FIG. 4 and assume different values, respectively, in dependence on the engine cooling water temperature WT at the time point the engine operation is started.

Figure 4:
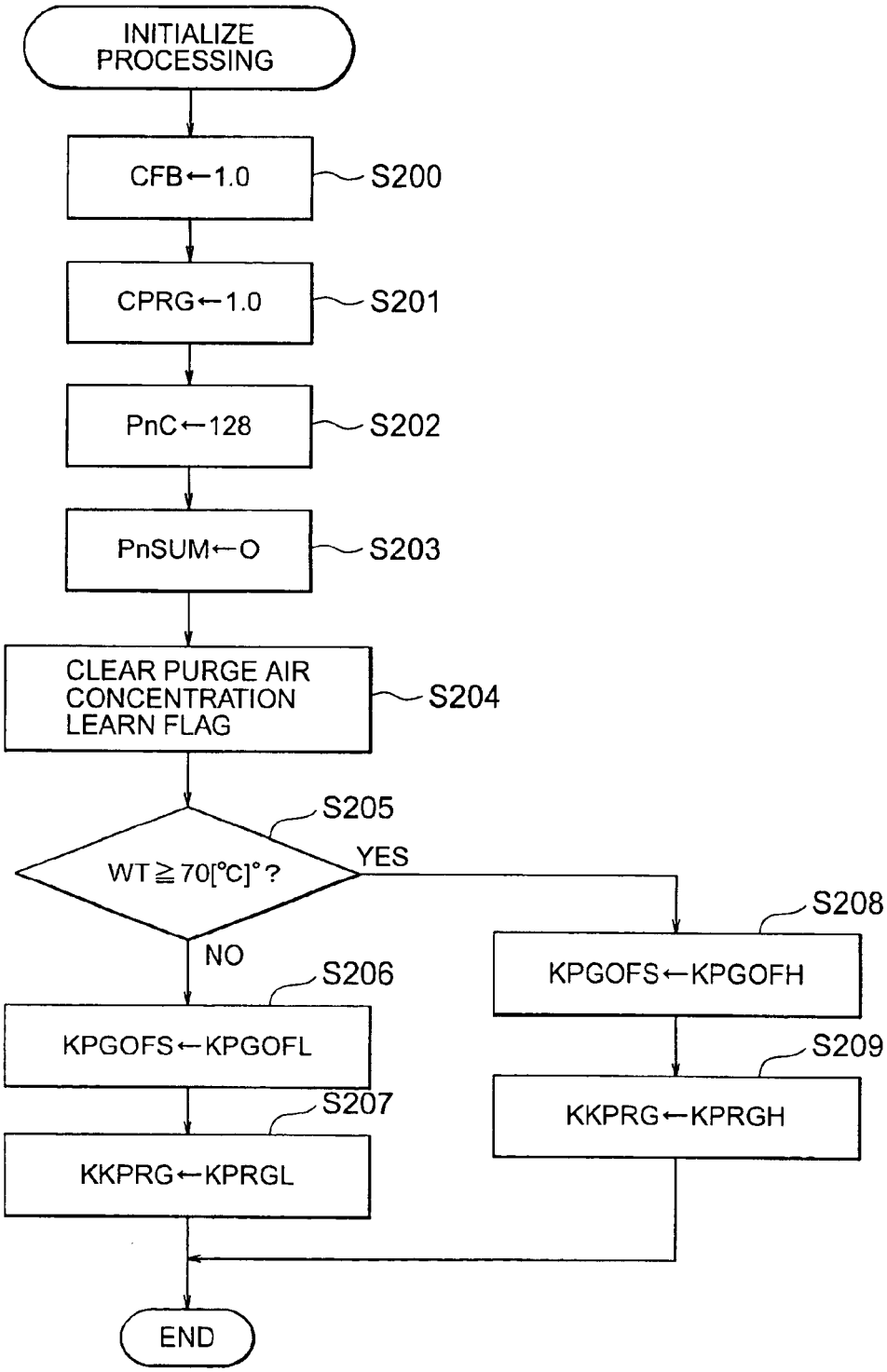
FIG. 4 is a flow chart for illustrating an initialize processing procedure according to the first embodiment of the invention.

FIG. 4 is a view illustrating in a flow chart an initialize processing routine which is executed at the time point the electric power is supplied to the engine control unit 20.

Referring to FIG. 4, in steps S200 to S203, initial values are set for the variables CFB, CPRG, PnC and PnSUM, respectively. More specifically, the initial value "1.0" is set for the air-fuel ratio feedback correcting coefficient CFB in the step S200, "1.0" is set for the purge air concentration correcting coefficient CPRG in the step S201, "128" is set for the purge air concentration integrating counter PnC in the step S202, and the initial value "0" is set for the integrated purge air concentration value PnSUM in the step S203, respectively.

In succession, a purge air concentration learn flag indicative of the purge air concentration having been learned is cleared to "0" (zero) in a step S204, which is then followed by steps S205 to S209 where the initial values conforming to the temperature of the engine 6 are imparted to the variables KPGOFS and KKPRG, respectively. More specifically, decision is made in the step S205 as to whether or not the engine cooling water temperature WT is higher than 70 [° C.] inclusive, to thereby determine whether or not the engine 6 has been warmed up.

When it is found in the step S205 that WT<70° C. (i.e., when the decision step S205 results in "NO"), it is then decided that the engine has not been warmed up yet, whereon the value KPGOFL determined previously for the start of engine operation at a low temperature is set as the initial purge air flow rate decreasing coefficient offset KPGOFS in the step S206.

Additionally, the value KPRGL determined in advance for the start of engine operation at the low temperature is set as the initial purge air flow rate decreasing coefficient gain KKPRG in the step S207, whereupon the processing routine shown in FIG. 4 comes to an end.

On the other hand, when it is found in the step S205 that WT≧70° C. (i.e., when the decision step S205 results in "YES"), it is then decided that the engine has already been warmed up, whereon the value KPGOFH for the start of engine operation at a high temperature is set as the initial purge air flow rate decreasing coefficient offset KPGOFS in the step S208.

Further, the value KPRGH for the start of engine operation at the high temperature is set as the initial purge air flow rate decreasing coefficient gain KKPRG in the step S209, whereupon the processing routine shown in FIG. 4 comes to an end.

Incidentally, the relation between the offset values (KPGOFL and KPGOFH) set when the engine operation is started at the low and high temperatures, respectively, as well as the relation between the gain values (KPRGL and KPRGH) set when the engine operation is started at the low and high temperatures, respectively, are given by the following expressions (4) and (5), respectively:

$$KPGOFL > KPGOFH \quad (4)$$

$$KPRGL < KPRGH \quad (5)$$

Ordinarily, the vaporized fuel gas adsorbed by the activated carbon contained in the canister 9 is difficult to desorb from the activated carbon when the temperature of the canister 9 is low. For this reason, the offset value KPGOFL for the low temperature is set to be greater than the offset value KPGOOFH for the high temperature, as can be seen in the expression (4) mentioned above.

Further, the low-temperature value KPRGL of the initial purge air flow rate decreasing coefficient gain KKPRG which determines the increasing rate of the initial purge air flow rate decreasing coefficient KPRG is set smaller than the high-temperature value KPRGH of the initial purge air flow rate decreasing coefficient gain KKPRG, as is apparent from the above-mentioned expression (5), in consideration of the fact that the temperature of the canister 9 increases as the engine 6 is warmed up to thereby allow the vaporized fuel gas to desorb easily from the activated carbon of the canister and that the quantity or amount of the fuel evaporation gas adsorbed by the activated carbon of the canister 9 is unknown.

On the other hand, when the engine operation is started at a high temperature, the temperature of the canister 9 is also high with the fuel evaporation gas being easy to desorb from the activated carbon. Accordingly, the offset value KPGOFH for the high temperature is set smaller than the offset value KPGOFL for the low temperature.

Next, referring to a flow chart shown in FIG. 5, the purge control processing executed by the air-flow ratio control apparatus according to the first embodiment of the invention shown in FIGS. 1 and 2 will be described in more detail.

Figure 5:
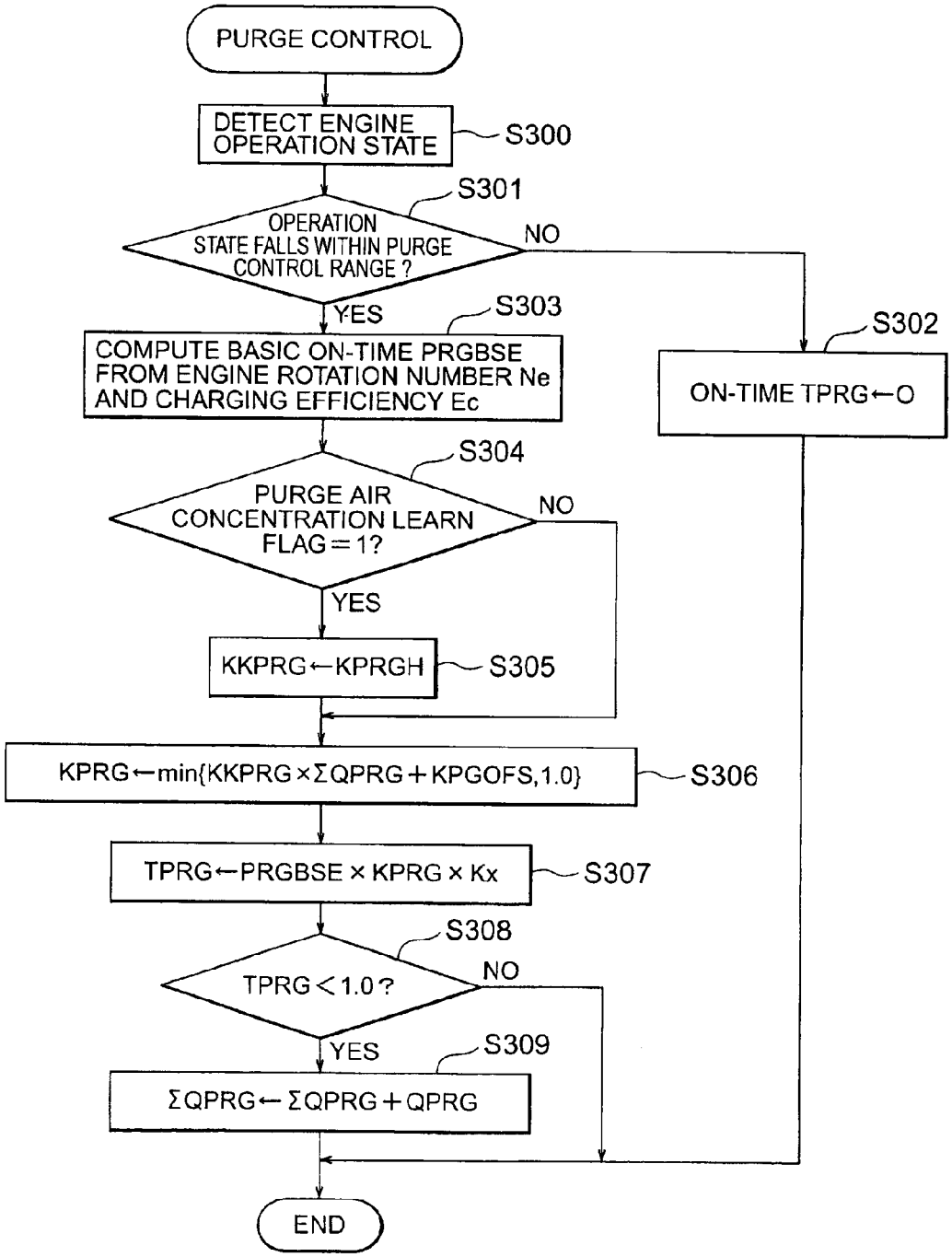
FIG. 5 is a flow chart for illustrating a purge control processing procedure according to the first embodiment of the invention.

Referring to FIG. 5, the detection signals outputted from the various sensors such as the crank angle sensor 17, the air flow sensor 2, the throttle sensor 12, the water temperature sensor 14 etc. are firstly fetched by the engine control unit 20 for detecting the operation state of the engine 6 in a step S300.

In succession, in a step S301, decision is made as to whether or not the detected engine operation state lies within a range in which the purge control can be performed. When it is decided that the detected engine operation state does not fall within the purge control range (i.e., when the decision step S301 results in "NO"), the on-time TPRG of the purge control valve 10 is set to "0" [msec] to set the purge control valve 10 to the closed state (step S302), whereupon the processing routine shown in FIG. 5 comes to an end (END).

On the other hand, when it is decided that the detected operation state of the engine falls within the range capable of controlling the purge process (i.e., when the decision step S301 results in "YES"), then the basic on-time PRGBSE of the purge control valve 10 is arithmetically determined by reference to the map data (see FIG. 6) determined and stored in advance on the basis of the engine rotation number Ne and the charging efficiency Ec in a step S302.

FIG. 6 is a view for illustrating exemplary map data of the basic on-time PRGBSE [msec] determined as a function of the engine rotation number Ne [rpm] and the charging efficiency Ec [%].

Further, FIG. 7 is a view for illustrating, by way of example, map data of the purge flow rate reference values QPRGBSE [g/sec] determined as a function of the engine rotation numbers Ne [rpm] and the charging efficiencies Ec [%].

The purge flow rate reference values QPRGBSE shown in FIG. 7 represent in the form of a map the experimentally determined value of the purge flow rates when the purge control valve 10 is controlled with the basic on-time PRGBSE being used as the control quantity.

Turning back to FIG. 5, when the basic on-time PRGBSE is computed in a step S303, decision is then made as to whether or not the purge air concentration learn flag is set to "1" in a step S304.

When it is decided that the purge air concentration learn flag is set to "1" (i.e., when the decision step S304 results in "YES"), it is then determined that the purge air concentration has been learned, whereon the initial purge air flow rate decreasing coefficient gain KKPRG set upon execution of the initialize processing (see FIG. 4) is reset to the value KPRGH for the engine starting operation at a high temperature in a step S305.

On the other hand, when it is decided that the purge air concentration learn flag is not set to "1" (i.e., when the decision step S304 results in "NO"), it is then determined that the purge air concentration has not been learned yet, whereon the processing proceeds to a step S306 without executing the step S305.

In this conjunction, it should be mentioned that the value KPRGH for the engine starting operation at a high temperature is set to be greater than the value of the initial purge air flow rate decreasing coefficient gain KKPRG set upon execution of the initialize processing so that the purge control quantity can be increased at a higher rate after the purge air concentration has been learned as compared with the state where the purge air concentration is not learned. This is because the air-fuel ratio undergoes no influence of the change of the purge ratio Pr after the purge air concentration has been learned and thus the purge quantity to be introduced can further be increased.

Subsequently, in a step S307, the initial purge air flow rate decreasing coefficient KPRG is computed in accordance with the expression (3) mentioned previously (step S306), and then the on-time TPRG of the purge control valve 10 is computed in accordance with the expression (2) mentioned hereinbefore on the basis of the initial purge air flow rate decreasing coefficient KPRG and the basic on-time PRGBSE computed in the step S303.

In succession, in a step S308, decision is made as to whether or not the initial purge air flow rate decreasing coefficient KPRG is smaller than "1.0". When it is determined that KPRG<1.0 (i.e., when the step S308 results in "YES"), a value resulting from the addition of the purge quantity QPRG (the value conforming to the on-time TPRG computed in the step S307) to the integrated purge quantity value QPRG is set as the new or updated value of the integrated purge quantity (step S309), whereupon the processing procedure shown in FIG. 5 comes to an end.

On the other hand, when it is decided in the step S308 that KPRG≧1.0 (i.e., "NO" in the step S308), the processing procedure shown in FIG. 5 is immediately terminated.

By the way, concerning the method of computing the purge quantity QPRG, description will be made in conjunction with the processing for arithmetically determining the purge ratio Pr described below.

Now, referring to the flow chart shown in FIG. 8, description will be made of the arithmetic processing procedure for determining the purge ratio Pr executed by the air-flow ratio control apparatus according to the first embodiment of the invention.

Figure 8:
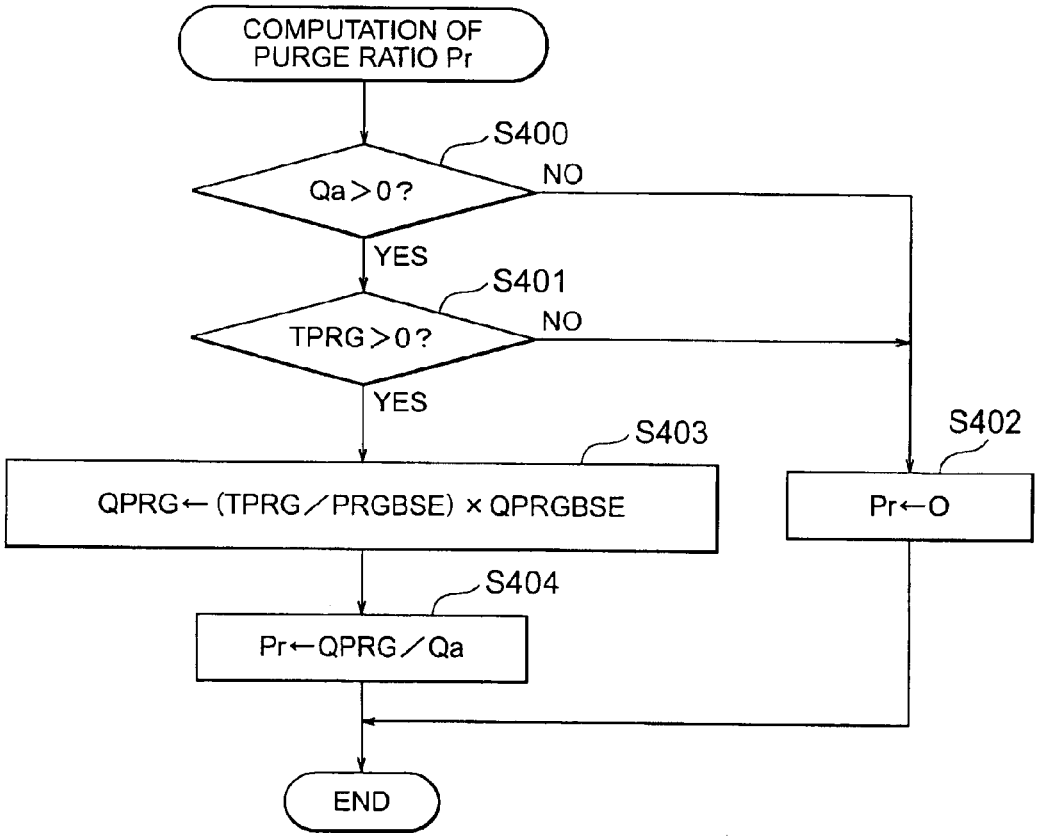
FIG. 8 is a flow chart illustrating an arithmetic processing procedure for computing a purge ratio (Pr) according to the first embodiment of the invention.

In more concrete, the processings illustrated in FIG. 8 are executed by the purge ratio arithmetic means 33 incorporated in the engine control unit 20 on the basis of the purge quantity QPRG and the intake quantity Qa.

Referring to FIG. 8, the purge ratio arithmetic means 33 makes decision whether or not the intake quantity Qa is detected as a positive value (i.e., value of plus sign) in a step S400. When it is determined that Qa>0 (i.e., when "YES" in the step S400), decision is then made as to whether or not the on-time TPRG of the purge control valve 10 (i.e., purge quantity QPRG) is computed as a positive value in a step S401.

When it is determined in the step S401 that TPRG=0 (i.e., when the step S401 results in "NO"), the purge ratio Pr is set to "0" (zero) in a step S402, whereupon the processing routine shown in FIG. 8 is terminated (END).

Similarly, when it is determined in the above-mentioned step S400 that Qa=0 (i.e., when "NO" in the step S400), the purge ratio Pr is set to zero in the step S402, and the processing procedure shown in FIG. 8 is terminated (END).

By contrast, when it is determined in the step S401 that TPRG>0 (i.e., when "YES" in the step S401), the purge quantity QPRG is computed on the basis of this on-time TPRG and the basic on-time PRGBSE and the purge flow rate reference value QPRGBSE arithmetically determined by reference to the map data shown in FIGS. 7 and 8 in accordance with the undermentioned expression (6):

$$QPRG=(TPRG/PRGBSE)\times \mathrm{QPRGBSE} \tag{6}$$

Finally, the purge ratio Pr is arithmetically determined on the basis of the purge quantity QPRG calculated in accordance with the expression (6) and the detected intake quantity Qa.

Namely, $$Pr=QPRG/Qa \tag{7}$$

The processing procedure shown in FIG. 8 now comes to an end.

At this juncture, it should be added that the arithmetic routine for computing the purge ratio Pr described above is executed every time the pulse signal outputted from the crank angle sensor 17 rises.

Next, referring to the flow chart shown in FIG. 9, description will be made of the learn procedure for learning the purge air concentration Pn executed by the air-flow ratio control apparatus according to the first embodiment of the invention.

Figure 9:
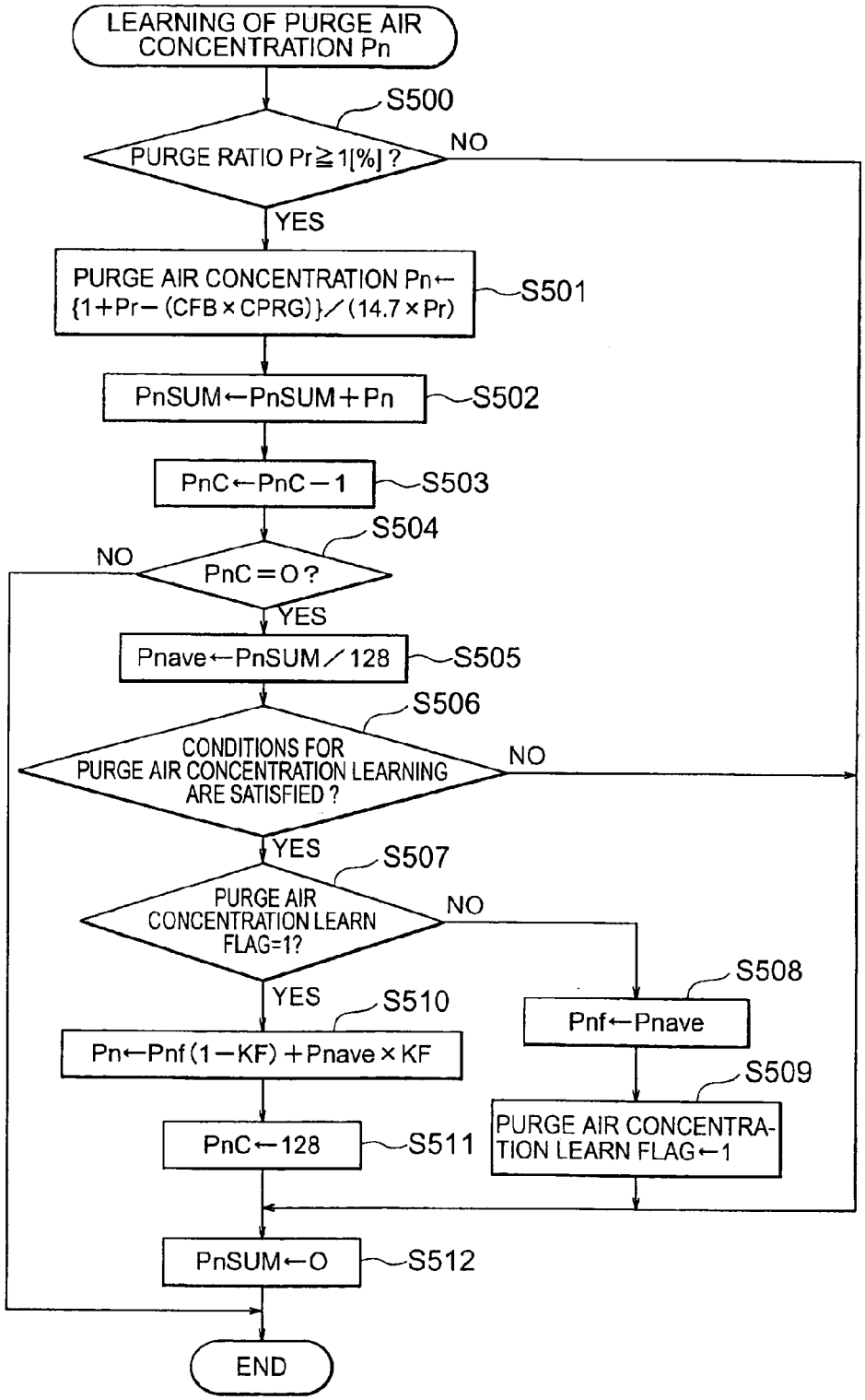
FIG. 9 is a flow chart illustrating a learn processing procedure for a purge air concentration (Pn) according to the first embodiment of the invention.

Referring to FIG. 9, it is firstly decided in a step S500 whether or not the purge ratio Pr is higher than 1 [%] inclusive. When it is determined that Pr<1 [%] (i.e., when the decision step S500 results in "NO"), then the integrated purge air concentration value PnSUM is immediately set to "0" in a step S512, whereupon the processing procedure shown in FIG. 9 comes to an end.

In this conjunction, it is to be mentioned that the reason why the arithmetic processing procedure for determining the purge air concentration Pn (steps S501 to S511 described hereinafter) is not executed when the purge ratio Pr is lower than 1 [%] can be explained by the fact that such error has to be avoided which is involved in the result of the arithmetic operation for determining the purge air concentration Pn and which increases as the purge ratio Pr becomes lower when deviation of the air-fuel ratio makes appearance due to the cause(s) other than the purge (e.g. due to the aged deterioration or secular change of the air flow sensor 2, variance of the characteristic of the fuel injector 7, etc.). In that case, the decision step S500 functions as the means for inhibiting the purge air concentration Pn from being updated.

By contrast, when it is determined in the step S500 that Pr≧1 [%] (i.e., when "YES" in the step S500), the purge air concentration Pn is computed in the step S501 on the basis of the purge ratio Pr, the air-fuel ratio feedback correcting coefficient CFB and the purge air concentration correcting coefficient CPRG in accordance with the undermentioned expression (8):

$$Pn=\{1+Pr-(CFB\times CPRG)\}/(14.7\times Pr) \tag{8}$$

In succession, the purge air concentration Pn determined in accordance with the expression (8) is added to the integrated purge air concentration value PnSUM to thereby update the integrated purge air concentration value in the step S502.

Further, the purge air concentration integrating counter PnC is decremented in the step S503, and decision is made as to whether or not the purge air concentration integrating counter PnC is counted down to "0" in the step S504.

When it is determined in the step S504 that PnC>0 (i.e., when the decision step S504 results in "NO"), then the processing routine illustrated in FIG. 9 is immediately terminated.

On the other hand, when it is determined in the step S504 that PnC=0 (i.e., "YES" in the decision step S504), then the average purge air concentration value Pnave is arithmetically determined from the integrated purge air concentration value PnSUM in accordance with the undermentioned expression (9):

$$Pnave=PnSUM/128 \tag{9}$$

Incidentally, the reason why the integrated purge air concentration value PnSUM is divided by "128" can be explained by the fact that the purge air concentration integrating counter PnC is set to "128" through the initialize processing (FIG. 4) in the step S202 and that the integrated purge air concentration value PnSUM subjected to the division results from integration performed 128 times.

The routine for learning the purge air concentration Pn shown in FIG. 9 is also executed every time the pulse signal outputted from the crank angle sensor 17 rises, similarly to the routine for arithmetically determining the purge ratio Pr (FIG. 8). Accordingly, the average purge air concentration value Pnave is updated 128 times upon every rising of the pulse signal outputted from the crank angle sensor 17.

In succession, decision is made as to whether or not the conditions for learning the purge air concentration are satisfied in the step S506. Unless satisfied (i.e., "NO" in the step S506), the integrated purge air concentration value PnSUM is set to "0" (i.e., PnSUM=0) in a step S512, whereupon the processing routine illustrated in FIG. 9 is terminated.

By contrast, when it is determined in the step S506 that the conditions for learning the purge air concentration are satisfied or valid (i.e., "YES" in the step S506), decision is made in the step S507 as to whether or not the purge air concentration learn flag is set to "1".

When it is determined in the step S507 that the purge air concentration learn flag is not set to "1" (i.e., when "NO" in the step S507), it is then determined that the purge air concentration Pn has firstly been computed after the start of operation of the engine 6, whereon the average purge air concentration value Pnave determined in the step S505 is set as the learned purge air concentration value Pnf in the step S508.

Further, the purge air concentration learn flag is set to "1" in the step S509, and then the step S512 mentioned previously is executed, whereupon the processing routine illustrated in FIG. 9 comes to an end.

In that case, since the average purge air concentration value Pnave is set as the learned purge air concentration value Pnf without performing the filter processing of the average purge air concentration value Pnave, it is possible to obtain the learned purge air concentration value Pnf in a short time.

On the other hand, When it is determined in the step S507 that the purge air concentration learn flag is set to "1" (i.e., when the step S507 is "YES"), then the filter processing is performed by using a filer constant KF ($1>KF\geqq 0$) to thereby compute the learned purge air concentration value Pnf in accordance with the undermentioned expression (10):

$$Pn=Pnf(1-KF)+Pnave\times KF \tag{10}$$

In succession, "128" is placed in the purge air concentration counter PnC (step S511) while the integrated purge air concentration value PnSUM is set to "0" (step S512), whereupon the processing routine illustrated in FIG. 9 comes to an end.

At this juncture, it should be mentioned that the processing procedure or routine shown in FIG. 9 constitutes the learned purge air concentration value arithmetic means incorporated in the engine control unit 20.

Figure 10:
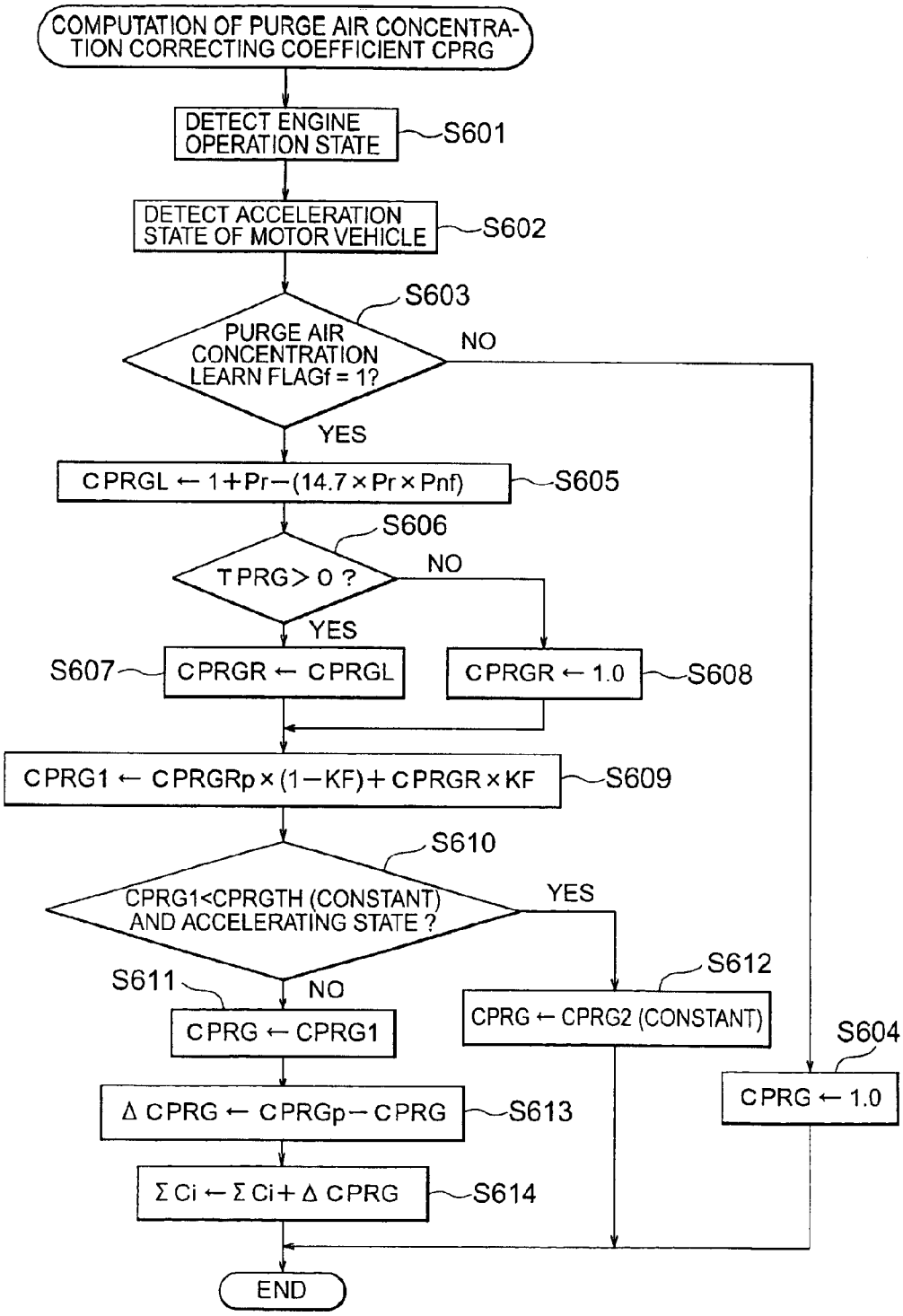
FIG. 10 is a flow chart illustrating an arithmetic processing procedure for a purge air concentration correcting coefficient (CPRG) according to the first embodiment of the present invention.

Next, referring to the flow chart shown in FIG. 10, description will be directed to the arithmetic processing for determining the purge air concentration correcting coefficient CPRG in the air-flow ratio control apparatus according to the first embodiment of the invention.

Referring to FIG. 10, the signals outputted from the crank angle sensor 17, the air flow sensor 2, the throttle sensor 12 and other(s) are fetched for detecting the operation state of the engine 6 in a step S601 to thereby determine whether or not the motor vehicle is in the accelerating state on the basis of the detected engine operation state.

In succession, it is decided whether or not the purge air concentration learn flag is set to "1" in a step S603. When the purge air concentration learn flag is not set to "1" (i.e., when the decision step S603 results in "NO"), it is determined that the purge air concentration Pn has not been learned yet, and hence the purge air concentration correcting coefficient CPRG is set to "1.0" in a step S604, whereupon the processing routine illustrated in FIG. 10 is terminated.

On the other hand, when the purge air concentration learn flag has already been set to "1" (i.e., when "YES" in the step S603), it is determined that the purge air concentration Pn has been learned. In this case, the learned instantaneous purge air concentration value CPRGL is computed in a step S605 on the basis of the purge ratio Pr and the learned purge air concentration value Pnf in accordance with the following expression (11):

$$CPRGL=1+Pr-(14.7\times Pr\times Pnf) \tag{11}$$

In succession, decision is made as to whether or not computation of the on-time TPRG results in a positive value (i.e., value of plus sign) in a step S606. When it is determined that TPRG >0 (i.e., when "YES" in the step S606), then the learned instantaneous purge air concentration value CPRGL computed according to the expression (1) is set as the basic purge air concentration correcting coefficient CPRGR in a step Ss607, whereas when TPRG=0 (i.e., when the step S606 results in "NO"), the basic purge air concentration correcting coefficient CPRGR is set to "1.0" in a step S608.

Subsequently, filter processing is performed for the basic purge air concentration correcting coefficient CPRGRp determined through the preceding processing or routine by using the filter constant KF ($1>KF>0$) to thereby arithmetically determine the ordinary purge air concentration correcting coefficient CPRG1 in accordance with the undermentioned expression (12) in a step S609.

$$CPRG1=CPRGRp\times(1-KF)+CPRGR\times KF \tag{12}$$

In succession, it is decided whether or not CPRG1<CPRGTH (constant) and whether or not the engine is in the accelerating state in a step S610. When it is determined that CPRG1<CPRGTH and that the engine is in the accelerating state (i.e., when the step S610 results in "YES"), then an acceleration-oriented purge air concentration correcting coefficient CPRG2 (constant) is set as the purge air concentration correcting coefficient CPRG in a step S612, whereupon the processing routine illustrated in FIG. 10 comes to an end.

By contrast, when it is determined in the step S610 that CPRG1≧CPRGTH or the engine is not in the accelerating state (i.e., when the step S610 is "NO"), then the ordinary purge air concentration correcting coefficient CPRG1 is set as the purge air concentration correcting coefficient CPRG in a step S611.

Subsequently, the purge air concentration correcting coefficient CPRG determined currently is subtracted from the purge air concentration correcting coefficient CPRGp determined precedingly to thereby derive a correcting coefficient deviation (deviation of the purge air concentration correcting coefficient) ΔCPRG (=CPRGp−CPRG) in a step S613.

Finally, an updated integrated feedback integration correcting coefficient value ΣCi is determined by subtracting the correcting coefficient deviation ΔCPRG from the integrated feedback integration correcting coefficient value ΣCi in a step S624, whereupon the processing routine illustrated in FIG. 10 comes to an end.

The integrated feedback integration correcting coefficient value ΣCi is used for arithmetically determining the air-fuel ratio feedback correcting coefficient CFB, as described hereinbefore.

As is apparent from the foregoing, so long as the engine is in the operation state in which the rich purge air of high purge ratio is being introduced with the purge air concentration correcting coefficient CPRG updated to a value indicating significant leanness due to the introduction of the purge air, a sudden acceleration of the engine will forcibly cause the purge air concentration correcting coefficient CPRG to shift immediately toward richness, whereby the acceleration performance is protected from degradation.

More specifically, when the purge air concentration correcting coefficient CPRG is smaller than a predetermined value (indicating leanness) and when it is determined that the motor vehicle is being accelerated, the purge air concentration correcting coefficient CPRG is reset to the initial value (=1.0). By virtue of this feature, the purge air concentration correcting coefficient CPRG can instantaneously and forcibly be shifted toward richness.

Further, by limiting the initial value by a value which reflects the predetermined value for the decision as to richness (a value intermediate the value 1.0 and the predetermined value), the engine can satisfactorily be controlled without impairing the acceleration performance even when acceleration is effectuated in the engine operation state where remarkably rich purge air is be introduced.

Many features and advantages of the present invention are apparent from the detailed description and thus it is intended by the appended claims to cover all such features and advantages of the apparatus which fall within the spirit and scope of the invention. Further, since numerous modifications and changes will readily occur to those skilled in the art, it is not desired to limit the invention to the exact construction and operation illustrated and described. Accordingly, all suitable modifications and equivalents may be resorted to, falling within the scope of the invention.

What is claimed is:

1. An air-fuel ratio control apparatus for an internal combustion engine, comprising:

sensor means of various types for detecting operation states of said internal combustion engine installed on a motor vehicle;

an air-fuel ratio sensor for detecting an air-fuel ratio of an air-fuel mixture gas supplied to said internal combustion engine;

a fuel injector for injecting a fuel contained in a fuel tank into an intake system of said internal combustion engine;

a canister for adsorbing a fuel vapor from said fuel tank;

a purge control valve for introducing the adsorbed fuel of said canister into said intake system of said internal combustion engine; and an engine control unit for activating said canister and driving said purge control valve on the basis of detection signals of said various sensor means and said air-fuel ratio sensor, wherein said engine control unit is comprised of:

acceleration decision means for making decision as to accelerating state of said motor vehicle on the basis of said engine operation state;

air-fuel ratio control means for arithmetically determining a fuel injection quantity on the basis of said engine operation state to thereby drive said fuel injector while controlling said air-fuel ratio to a desired value thereof through a feedback control on the basis of said detection signal of said air-fuel ratio sensor;

purge control means for driving said purge control valve on the basis of said engine operation state; and fuel correction arithmetic means for arithmetically determining a purge air concentration correcting coefficient for correcting said fuel injection quantity on the basis of the control quantity for said purge control valve validated by said purge control means and said engine operation state, wherein said fuel correction arithmetic means is so designed as to reset said purge air concentration correcting coefficient to an initial value when said purge air concentration correcting coefficient becomes smaller than a predetermined value inclusive thereof, indicating leanness of said air-fuel mixture and when it is determined that said motor vehicle is in the accelerating state.

2. An air-fuel ratio control apparatus for an internal combustion engine according to claim 1, wherein said air-fuel ratio control means is so designed as to control an air-fuel ratio feedback correcting coefficient for correcting said air-fuel ratio so that said air-fuel ratio coincides with said desired value; and wherein said fuel correction arithmetic means is comprised of:

purge quantity arithmetic means for arithmetically determining a purge quantity introduced actually into said intake system on the basis of said control quantity for said purge control valve and said engine operation state;

purge ratio arithmetic means for arithmetically determining a ratio of said purge quantity to an intake air quantity of said internal combustion engine as a purge ratio on the basis of said purge quantity and said engine operation state;

purge air concentration arithmetic means for arithmetically determining a purge air concentration on the basis of said purge ratio and said air-fuel ratio feedback correcting coefficient; and purge air concentration correcting means for arithmetically determining said purge air concentration correcting coefficient on the basis of said purge ratio and said purge air concentration, wherein said air-fuel ratio control means is designed to arithmetically determine said fuel injection quantity on the basis of said purge air concentration correcting coefficient.

3. An air-fuel ratio control apparatus for an internal combustion engine according to claim 1, wherein the initial value of said purge air concentration correcting coefficient is set to 1.0.

4. An air-fuel ratio-control apparatus for an internal combustion engine according to claim 1, further comprising:

initial value setting means for setting variably the initial value of said purge air concentration correcting coefficient so that said initial value can be set to a value which reflects said predetermined value.

* * * * *